US009640155B2

(12) United States Patent
Junod

(10) Patent No.: US 9,640,155 B2
(45) Date of Patent: May 2, 2017

(54) MUSIC BOX WITH VISUAL ANIMATION

(71) Applicant: Francois Junod, Sainte-Croix (CH)

(72) Inventor: Francois Junod, Sainte-Croix (CH)

(73) Assignee: REUGE SA (CH)

( * ) Notice: Subject to any disclaimer, the term of this patent is extended or adjusted under 35 U.S.C. 154(b) by 0 days.

(21) Appl. No.: 15/308,980

(22) PCT Filed: May 5, 2015

(86) PCT No.: PCT/EP2015/059827

§ 371 (c)(1),
(2) Date: Nov. 4, 2016

(87) PCT Pub. No.: WO2015/169792

PCT Pub. Date: Nov. 12, 2015

(65) Prior Publication Data

US 2017/0061943 A1 Mar. 2, 2017

(30) Foreign Application Priority Data

May 6, 2014 (CH) ..... 677/14

(51) Int. Cl.

| | |
|---|---|
| ***G10F 1/06*** | (2006.01) |
| ***A63H 33/22*** | (2006.01) |
| ***A63H 33/26*** | (2006.01) |
| ***A63H 13/20*** | (2006.01) |
| ***G09F 19/08*** | (2006.01) |

(52) U.S. Cl.

CPC ..... *G10F 1/06* (2013.01); *A63H 13/20* (2013.01); *A63H 33/22* (2013.01); *A63H 33/26* (2013.01); *G09F 19/08* (2013.01)

(58) Field of Classification Search

CPC ..... G10F 1/06; A63H 33/22; A63H 13/20; A63H 33/02; G09F 19/08

USPC ..... 84/94.1, 95.2

See application file for complete search history.

(56) References Cited

U.S. PATENT DOCUMENTS 1,589,432 A * 6/1926 Sapp ..... A63H 13/00 40/411
3,535,819 A * 10/1970 Spilhaus ..... G10F 1/06 446/229
3,629,970 A * 12/1971 Baynes ..... A63H 17/00 446/414
4,344,243 A * 8/1982 Reszka ..... G09F 19/08 40/414

(Continued)

FOREIGN PATENT DOCUMENTS

CH 287253 11/1952
CH 352221 2/1961

(Continued)

*Primary Examiner* — David Warren
*Assistant Examiner* — Christina Schreiber
(74) *Attorney, Agent, or Firm* — Galbreath Law Offices, P.C.; John A. Galbreath

(57) ABSTRACT

The invention relates to a musical box comprising: a comb (30) with a plurality of vibrating blades (3) of different lengths so as to produce audible sounds of different frequencies when the vibrating blades are vibrated; a plate or a cylinder (2) provided with points (20) so as to alternately vibrate the different vibrating blades (3) when the plate or cylinder is rotated; and a visual animation device (4, 5) actuated by said blades.

18 Claims, 11 Drawing Sheets

(56) References Cited

U.S. PATENT DOCUMENTS 4,538,803 A * 9/1985 Goldfarb ..... A63H 13/20 472/6
4,554,856 A * 11/1985 Esaki ..... G10F 1/06 84/95.2
4,670,820 A * 6/1987 Eddins ..... A63H 5/00 362/190
4,804,348 A * 2/1989 Bondi ..... A63J 19/00 446/352
4,890,528 A * 1/1990 Kamijima ..... G10F 1/06 84/95.2
4,983,890 A * 1/1991 Satoh ..... A41G 1/002 318/14
4,987,787 A * 1/1991 Hou ..... F16H 21/36 428/16
5,040,319 A * 8/1991 Wang ..... G09F 19/08 40/414
5,161,420 A * 11/1992 Feng ..... A63H 13/20 74/53
5,235,865 A * 8/1993 Feng ..... F16H 37/12 40/414
5,371,318 A * 12/1994 Hsu ..... G10F 1/06 40/418
5,696,333 A * 12/1997 Shih ..... A45C 11/16 206/6.1
5,698,801 A * 12/1997 Meng-Suen ..... A63H 5/00 226/118.4
6,390,881 B1 * 5/2002 Yu ..... A63H 13/04 40/414
2005/0059501 A1 * 3/2005 Ballin ..... A63G 4/00 472/106
2008/0125006 A1 * 5/2008 Yu ..... A63H 29/22 446/298
2015/0343321 A1 * 12/2015 Liu ..... A63H 33/26 446/484

FOREIGN PATENT DOCUMENTS

CH 704425 7/2012
DE 8907416 8/1989
DE 8907416 U1 * 8/1989 ..... G01F 1/06
GB 2239730 8/1989
JP GB 2239730 A * 7/1991 ..... A63H 5/00

* cited by examiner

MUSIC BOX WITH VISUAL ANIMATION

TECHNICAL FIELD

The present invention concerns a music box with visual animation.

STATE OF THE ART

There are known in the state of the art music boxes which produce music when a crank is turned or a spring is tensioned by means of a key. Cylinder music boxes are produced since the end of the $18^{th}$ century for an entertaining or decorative purpose. These music boxes include a cylinder fitted with tips which raise and release, in a well-defined order, the perfectly tuned blades of a metallic comb. The vibration of the blades with different lengths produces the different notes of a tune defined by the position of the tips on the cylinder. Some advanced music boxes allow changing the tune by slightly shifting the cylinder in order to present another series of tips. In other music boxes, the cylinder is replaced with a disc or plate.

The music box may constitute an object on its own, for example integrated into a wood-worked box, or it may be integrated to another object, for example a pendulum, a snuffbox, etc. For simplicity, the expression « music box » will be used in the present application even when this mechanism is integrated into an object fulfilling another function.

In order to animate these music boxes, it is known to equip them with a visual animation, for example a dancer which turns at a speed related to the speed of the cylinder, a songbird, etc. However, the speed of displacement of the animation is independent from the rhythm of the music which is determined by the position of the tips on the cylinder or plate.

BRIEF SUMMARY OF THE INVENTION

Hence, an object of the present invention is to propose a music box provided with a visual animation different from the known animations.

Another object is to provide a music box provided with a visual animation which depends on the musical tune which is played.

According to the invention, these objects are achieved in particular by means of a music box including:

a comb with a plurality of vibrating blades with different lengths so as to produce audible sounds with different frequencies when the vibrating blades are vibrated;

a plate or a cylinder provided with tips so as to alternately vibrate the different blades when the disc or cylinder is rotated;

a visual animation device actuated by said blades.

The advantage is to produce an animation which depends on the position of the tips on the disc or cylinder, and therefore depending on the tune played.

For example, the rhythm of the melody may determine the displacement times of different portions of the animation device.

For example, the sequence of the played notes may determine which components of the animation device move according to which sequence, which allows visualizing the played notes.

The visual animation device may include several components independently actuated by different blades or tips.

The visual animation device may include a plurality of projectiles arranged to be actuated by the blades so as to be projected upwards when these blades are vibrated.

A projectile may be associated with each blade.

The projectiles may be constituted by balls, for example beads.

A retaining element may be associated with each projectile so as to ensure that the projectile falls back on a blade.

The retaining element may be constituted by a tube associated with each projectile to ensure that a projectile in the tube falls back on the blade which has projected it.

The number of tubes may be equal to the number of blades.

The tubes may be at least partially transparent in order to see the projectiles, at least during part of their trajectory when they are projected.

The tubes may flare upwardly, so as to minimize the risk of contact between the tube and the projectile upward of the trajectory, while ensuring that the projectile falls back in the intended location.

The tubes may be disposed in line.

The tubes may be disposed in a random arrangement in order to enlarge the diameter of each tube and each projectile in the tubes.

Several tubes may be combined together into a single injection-molded plastic element.

Each tube may be disposed along a direction orientated upwards.

Each tube may include an opening for bringing the projectile into contact with a corresponding vibrating blade.

Each tube may include a retainer to prevent the projectile from getting out from the bottom of the tube when it falls back.

A rod may be used as a retaining element associated with each projectile. This rod may be rotated and/or deformed upon displacement of the projectile.

A flexible wire or a rigid rod may be used as a retaining element associated with each projectile.

The projectiles may be made for example of a synthetic material, sagex, metal, glass, etc.

An intermediate blade may be associated with each vibrating blade to dampen the emitted sound.

The projectiles may fall back on this damping blade so as to attenuate the noise of the projectile that falls back.

The projectiles may be made for example of a precious stone, such as diamond, a semi-precious stone, ceramics such as zirconium, cut glass, etc.

The projectiles may be made of a softer material and/or with a lower density than the material of the blades of the comb.

The projectiles may serve as a damper for damping the vibrations of the blades after the projectile has fallen back.

BRIEF DESCRIPTION OF THE FIGURES

Examples of embodiments of the invention are indicated in the description illustrated by the appended figures in which.

EXAMPLE(S) OF EMBODIMENTS OF THE INVENTION

Figure 1:
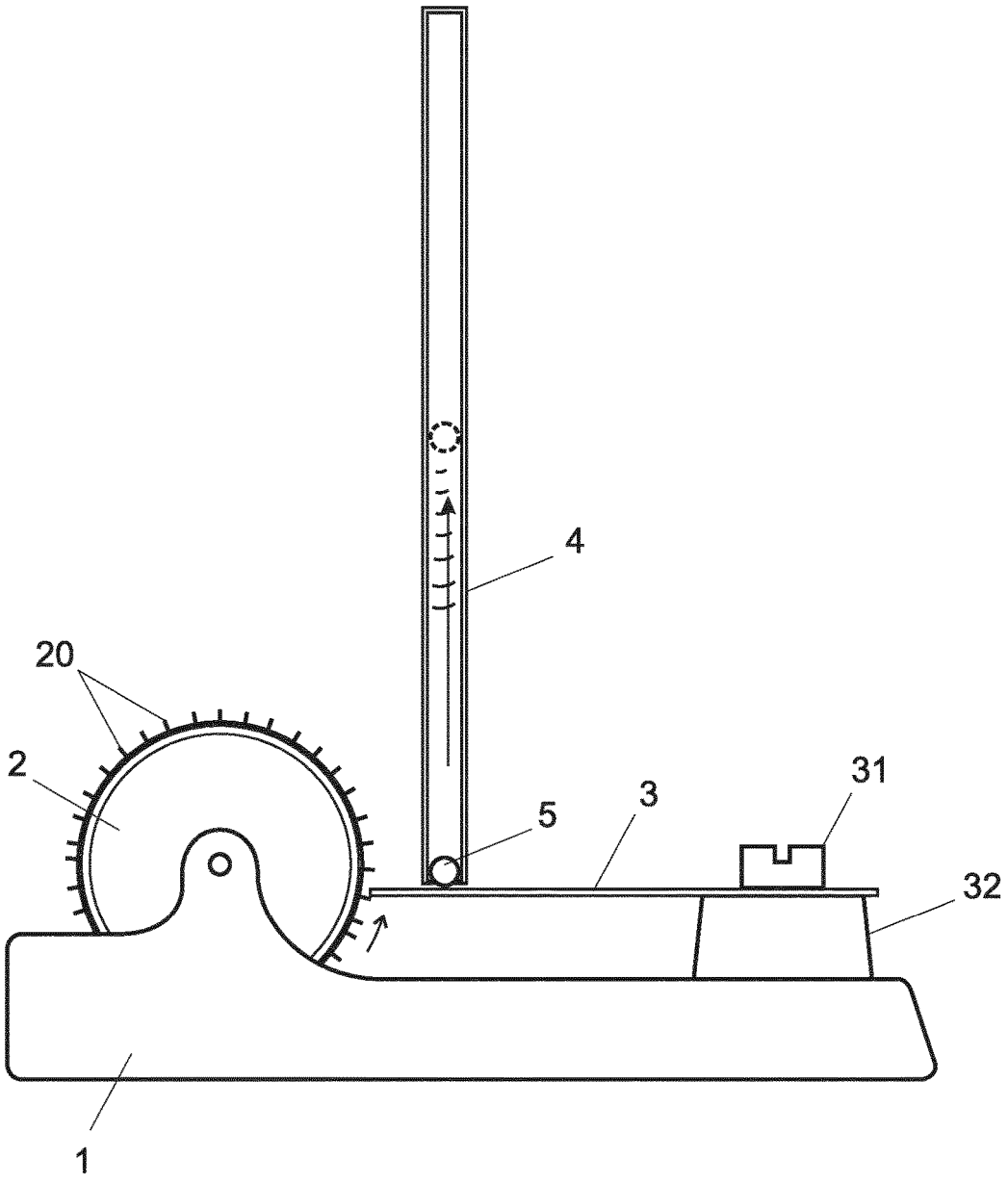
FIG. 1 illustrates an overall view of a music box according to a first embodiment of the invention.

A music box according to a first embodiment is illustrated in a side view in FIG. 1. It comprises a frame 1 on which a cylinder 2 is mounted. The cylinder 1 may be rotated by means of a non-illustrated mechanism, for example with a crank, a barrel associated with a speed regulator, etc. The periphery of the cylinder 2 is provided with tips 20 the arrangement of which determines the tune played by the music box. These tips 20 allow vibrating the blades 3 of a comb so as to produce musical notes. Although the illustrated view shows only one blade, it will be understood that the comb includes several blades in a plane perpendicular to the page, the length of the blades being tuned so as to correspond to musical notes. The comb is secured at the right height opposite the cylinder 2 by means of a socket 32 and a screw 32. Until then, the music box is conventional. The cylinder may also be replaced by a plate provided with tips. The cylinder may be provided with several series of tips and a mechanism allowing shifting it according to a direction perpendicular to the page so as to play different tunes depending on the position. The cylinder may be replaceable by another cylinder corresponding to another tune.

The music box according to this embodiment of the invention further includes a set of projectiles 5 intended to be projected upwards by the vibrations of the blades 3. For example, the projectiles may consist of balls, including beads, light enough to be projected at a right height. Balls made of a synthetic material, metal, glass, or any other material, may be used for this purpose. It is also possible to use non-spherical projectiles, for example cylindrical projectiles.

In one embodiment, the projectiles are constituted by stones, for example precious stones such as diamonds, semi-precious stones or synthetic or ceramic stones, such as zirconium. The stones may be cut and/or provided with facets to produce rainbow effects. This variant is in particular suitable for relatively large-sized music boxes, capable of projecting stones at heights of a few centimeters or tens of centimeters. It may also be applied to embedded music boxes for example in a wrist-watch, to displace stones over a shorter distance, for example directly under the glass, parallel to the glass and the dial.

A projectile may be associated with each vibrating blade. Each projectile may have a color or a different aspect. The mass of the different projectiles may be different, for example so as to compensate the differences of the kinetic energy transmitted by the different blades with different lengths.

The music box further includes retention means to prevent the projectiles from being lost by being projected in undesirable directions. In this embodiment, the retention means are constituted by tubes 4, for example, transparent, translucent or partially transparent tubes, in which the projectiles can be displaced. A tube may be associated with each blade 3 and each projectile 5. The tubes may be secured in a box, which is not represented in this figure, and which contains the mechanism. A portion of the tubes may extend above the box.

The tubes include an opening at their lower end, so as to allow the vibrating blades to hit the projectiles in the tubes when these blades vibrate under the action of the tips 20. A retainer 50, for example an annular retainer or an annular segment, prevents the projectiles from leaving their tubes by the bottom. A portion of the projectile gets out, however, under the tube so that it can be hit by the corresponding vibrated blade.

The upper end of the tubes may be closed in order to prevent the loss of the projectiles when the box is turned over or shaken, or opened to prevent the compression of air in the upper portion of the tube when the projectile rises. A retainer may also be provided in the upper portion of the tube to prevent the projectiles from leaving the tubes, without completely obstructing the tubes.

It is possible to coat at least one portion of the upper face of each vibrating blade 3 with a damping carpet or coating to reduce the impact with the projectile falling back.

Figure 2:
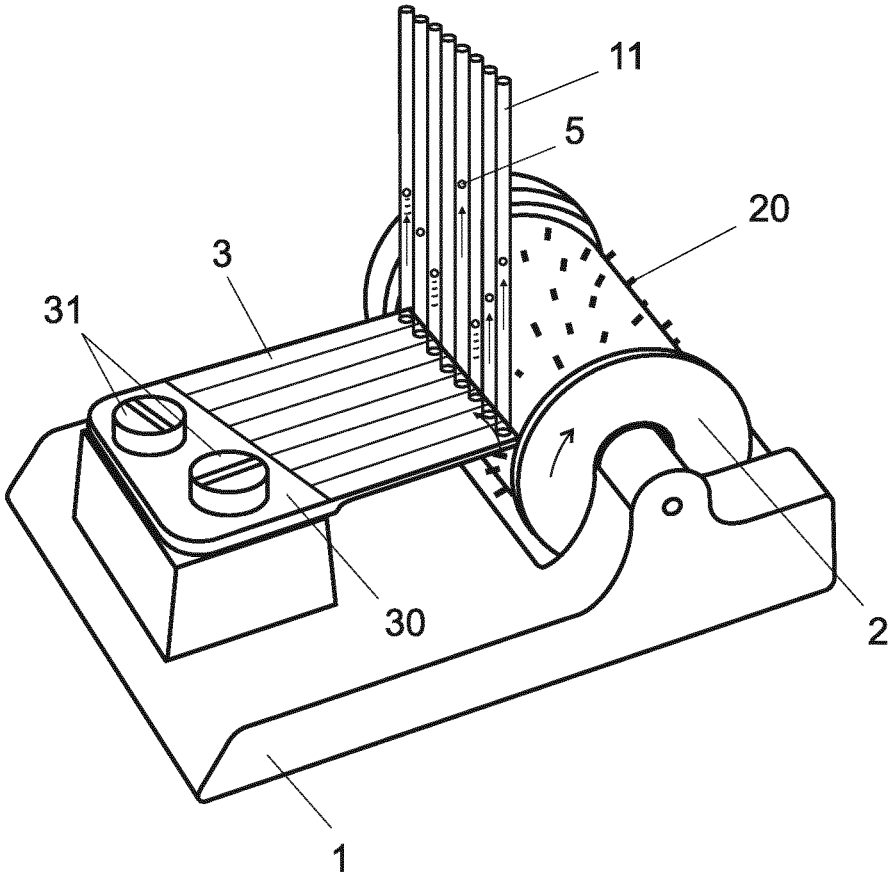
FIG. 2 illustrates an overall view of a music box according to a sixth embodiment of the invention.

FIG. 2 illustrates a perspective view of the music box according to the first embodiment. The different blades 3 of the comb 30, and the different tubes 11 aligned above the comb 30, with a tube over each blade are viewed in particular in this perspective view.

Figure 3:
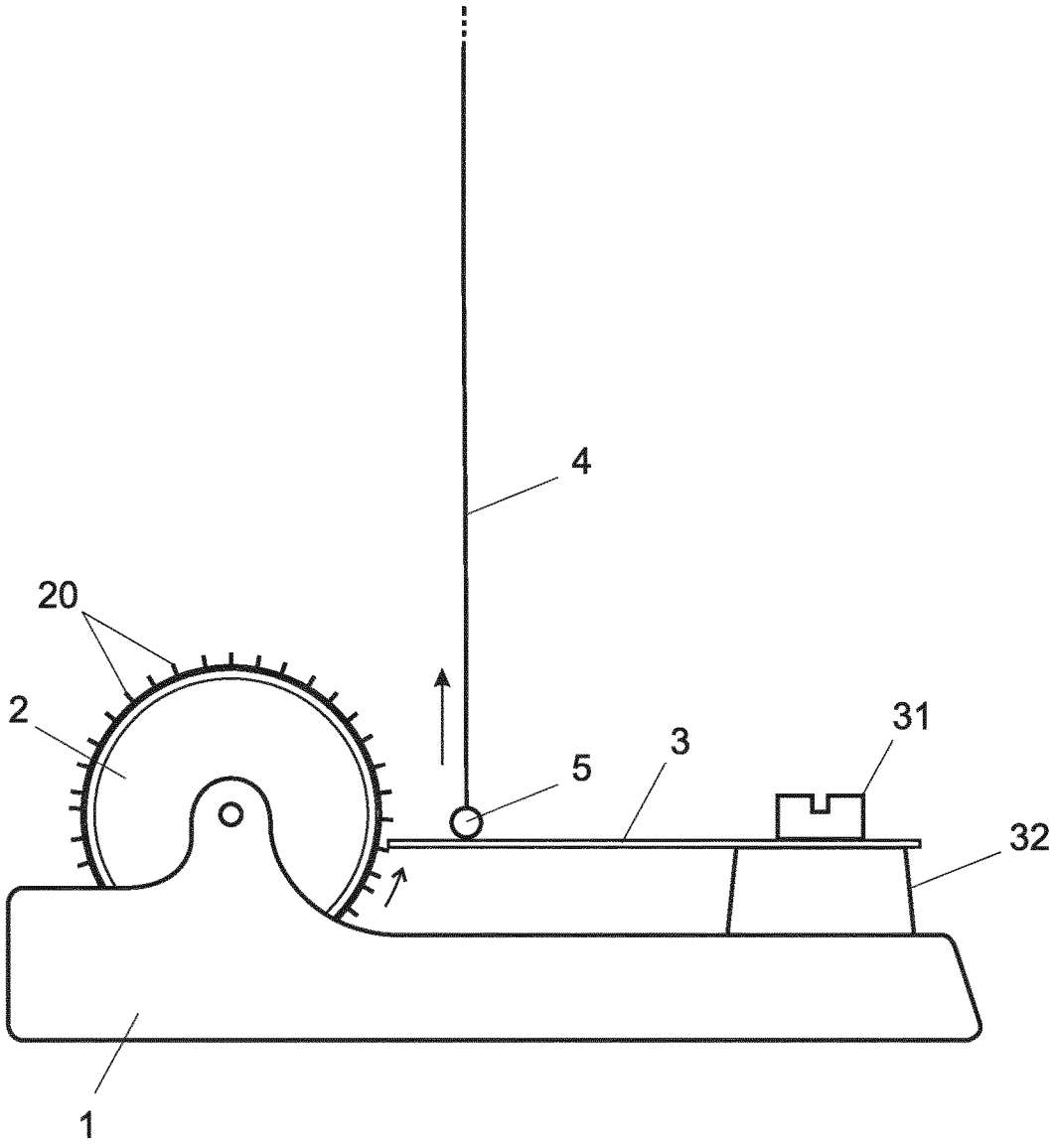
FIG. 3 illustrates an overall view of a music box according to a second embodiment of the invention.

FIG. 3 illustrates another embodiment similar to that of FIG. 1, but in which the projectiles 5 are suspended by flexible wires 6 held for example on the cover of the music box. The flexible wires 6 replace the tubes 11 as retention means to prevent the loss of the projectiles, and are deformed when the hooked projectile is hit by the corresponding vibrating blade.

Figure 4:
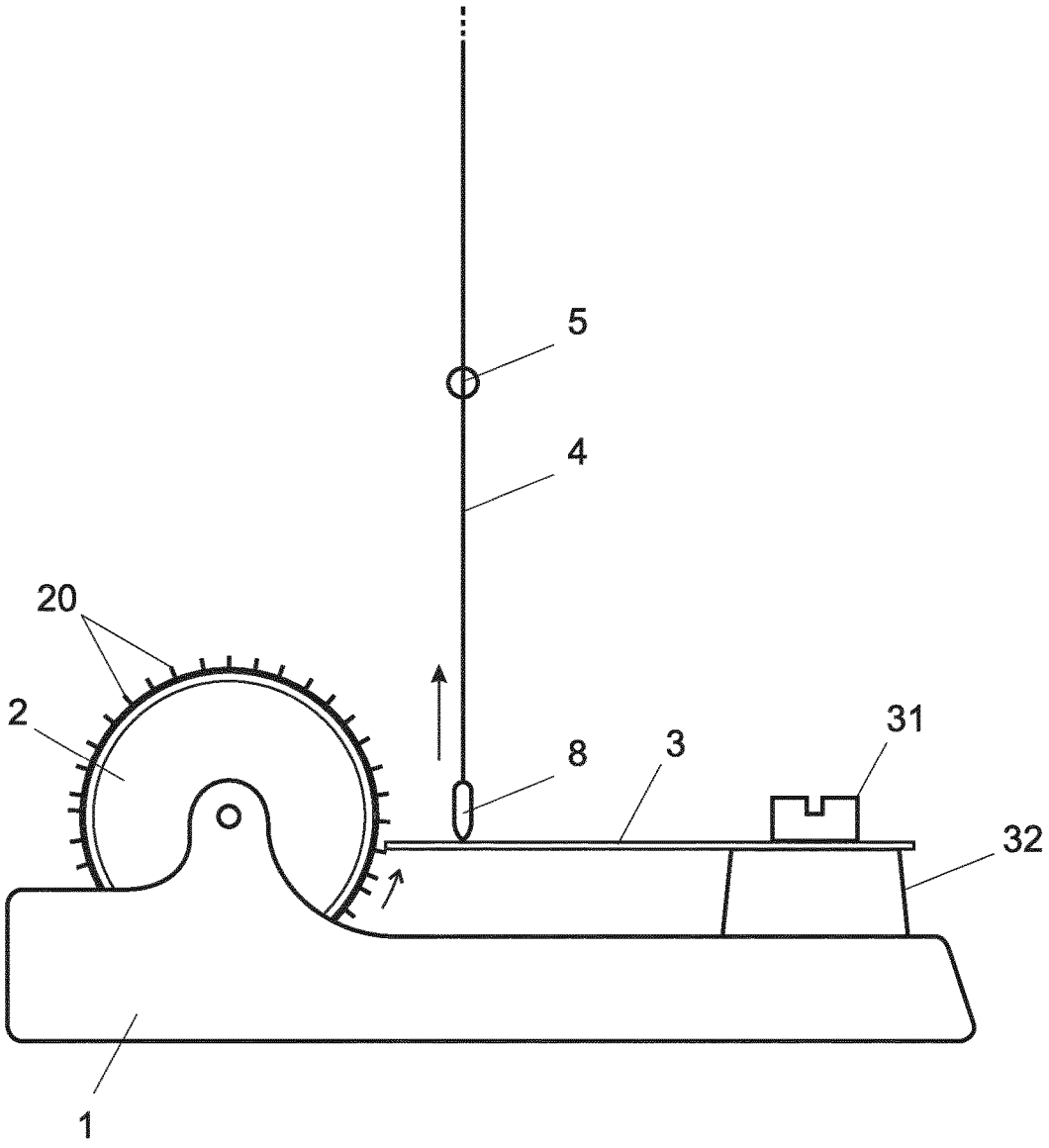
FIG. 4 illustrates an overall view of a music box according to a third embodiment of the invention.

FIG. 4 illustrates a third embodiment in which each projectile 5 is pierced with a hole through which a rigid wire 7, for example a transparent wire, passes in the same manner as a pearl on the wire of a necklace. A launcher 8 at the lower end of the wire 7 can transmit the kinetic energy received upon impact of the blade to the projectile 5 which then rises along the rigid wire. This solution avoids the use of the tube and allows a better view of the projectiles 5.

Figure 5A:
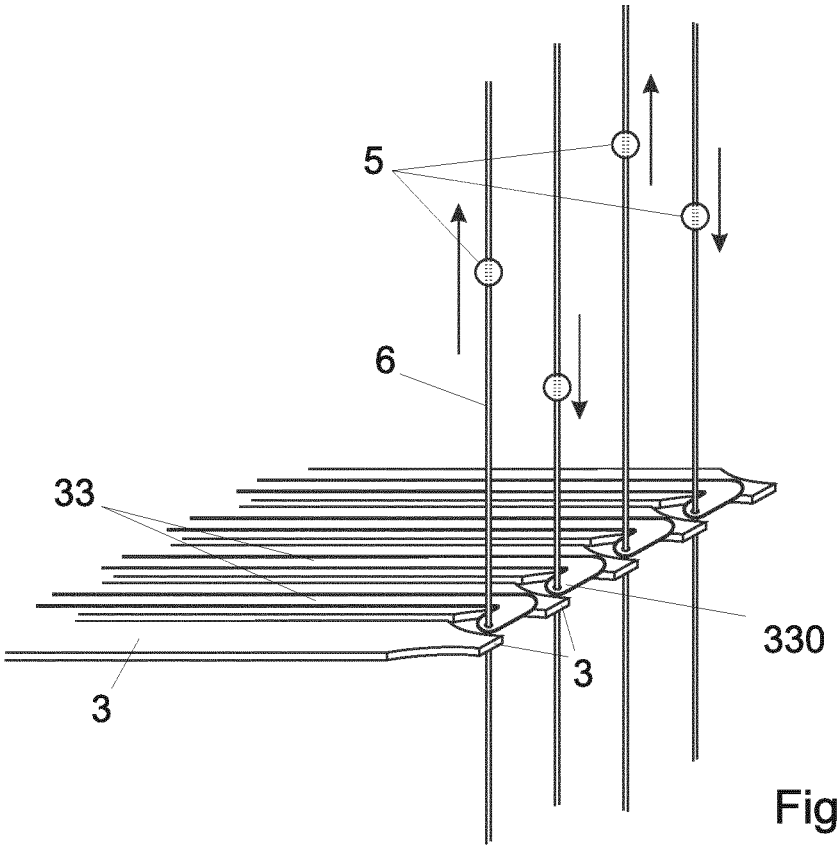
FIGS. 5A and 5B illustrate a perspective view, respectively a top view, of the blades of a music box according to a fourth embodiment of the invention.
Figure 5B:
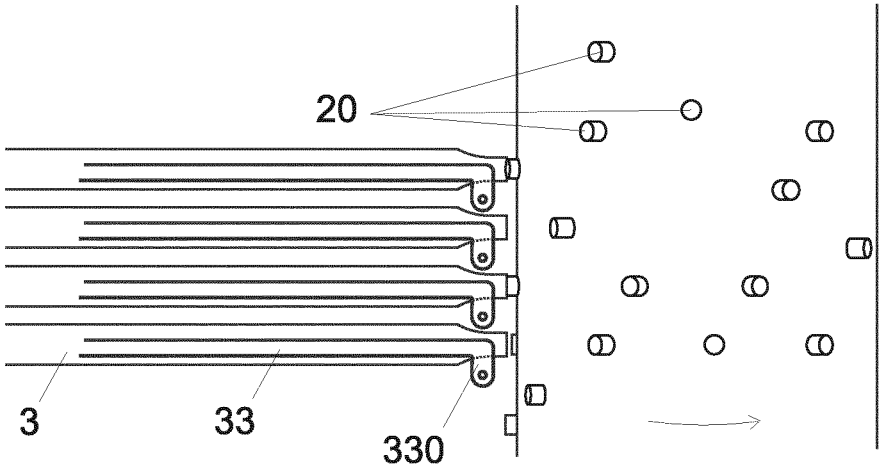

FIGS. 5A and 5B illustrate a fourth embodiment in which, similarly to the embodiment of FIG. 4, each projectile 5 is pierced with a hole through which a taut wire 6 passes, for example a transparent wire. An intermediate damping blade 33 is mounted above each vibrating plate 3; it includes a portion 330 projecting perpendicular to the end through which this wire 6 passes. The intermediate blade 33 is vibrated when the corresponding vibrating plate 3 is actuated. Advantageously, at rest, the projectile 5 is set on the portion 330, and projected into the air by the vibrations communicated to this intermediate blade by the main blade when the main blade 3 is actuated by the tips 20 of the cylinder 2. With respect to the version of FIG. 4, this solution allows avoiding the use of a launcher 8 and a rigid wire, since the vibrations are directly transmitted to the projectile 5 by the intermediate blade 33.

The blade 33 is advantageously made of a material softer than the steel-made vibrating plate 3, which allows avoiding the noise or even the risk of breakage of the projectile 5 when it falls back, in particular in the case of a precious or glass projectile for example. This blade 33 further allows damping the vibrations of the main blade 3, and therefore reducing the duration of the emitted sound.

Moreover, the thickness of the different intermediate blades 33 placed above the different vibrating blades 3 may be variable in order to at least partially compensate the difference of energy transmitted to the projectile according to the length of the vibrating blade, and therefore obtaining projection heights substantially constant regardless of the played note. Finally, the intermediate blade 33 also operates as a damper for damping the vibrations of the vibrating blade, controlling the period during which the note is played, and reducing the risk of collision with the following tip 20.

It is also possible to coat at least one portion of the upper face of each damping blade 33 with a damping carpet or coating to reduce the impact with the projectile falling back.

Figure 6:
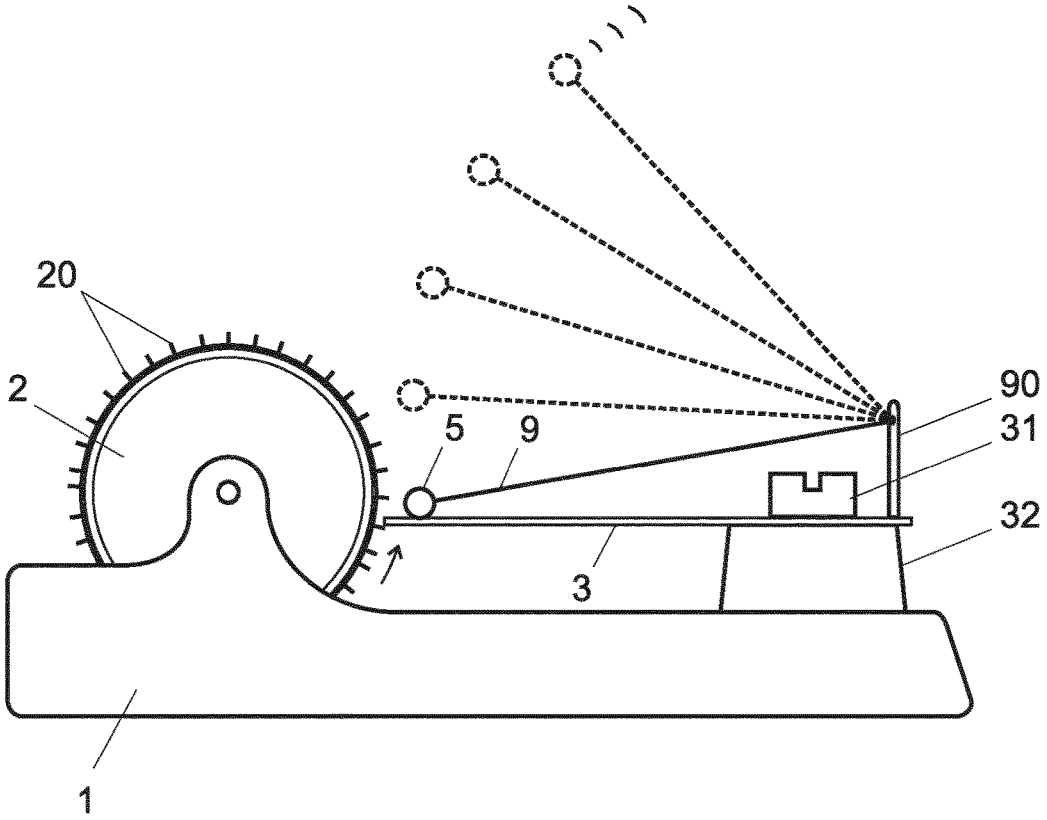
FIG. 6 illustrates an overall view of a music box according to an fifth embodiment of the invention.

FIG. 6 illustrates a fifth embodiment in which the projectiles 5 are mounted at the first end of a rod 9 the other end of which is pivotable about a horizontal axis 90, in the same manner as a piano hammer. The vibrations of the blade are transmitted to the projectile 5 which then pivots with the rod about the axis 90. The diameter of the rods is preferably reduced in order to lighten them and increase the maximum height reached by the projectile. Since fine rods risk being flexible, it is possible to provide a support, which is not represented, between the horizontal axis 90 and the projectile on which the rods come to rest in a horizontal position when they are not projected. The support may also serve as a guide for the rods, and may be provided for this purpose with vertical guide slots to guide the rods 9 during their rotation; at rest, each rod may be inserted into a slot which ensures an accurate positioning over the corresponding blade.

Figure 7:
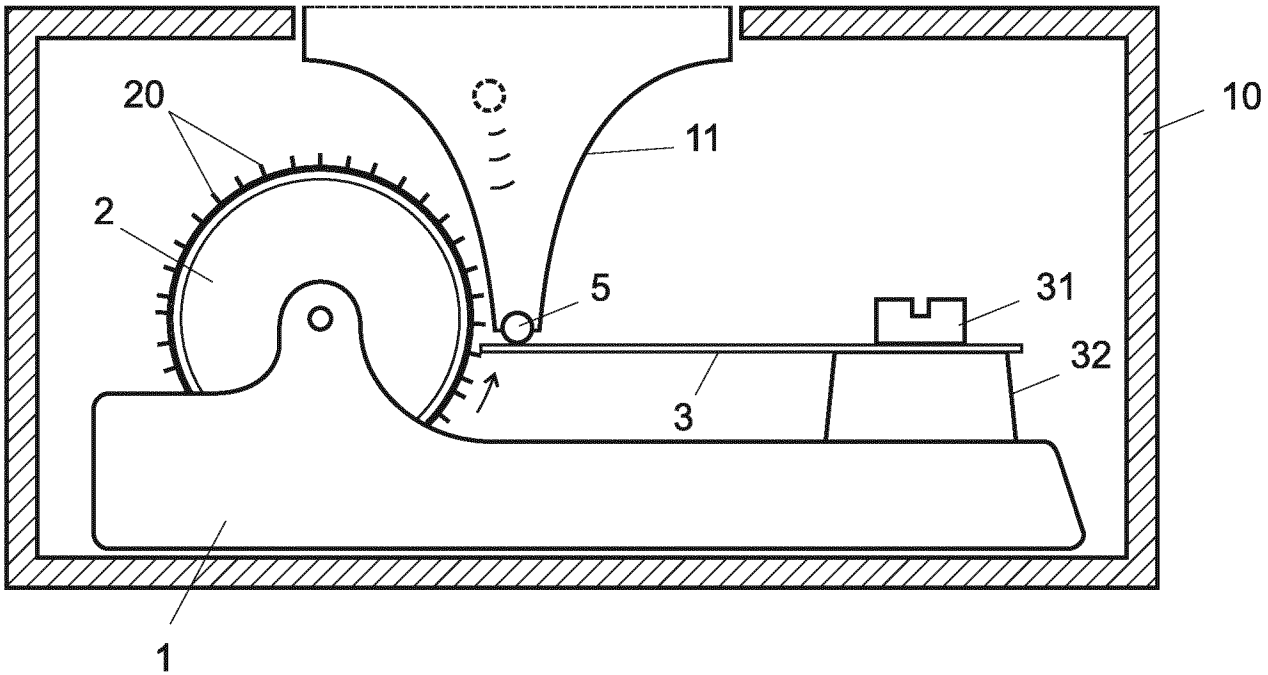
FIG. 7 illustrates an overall view of a music box according to a sixth embodiment of the invention.

FIG. 7 illustrates a sixth embodiment in which the projectiles 5 are retained in tubes 11 flaring upwardly in a funnel-like fashion. This solution allows expediting the projectiles according to a direction which is not strictly vertical, without the risk of an impact between the projectile and the walls of the corresponding tube before the projectile 20 falls back. The top of the open tube may be open or closed by a transparent cover so as to see the projectiles from the top.

It is also possible to provide a single straight or funnel-shaped tube which is shared by the different projectiles. There is then the risk that the projectiles do not fall back on the blade which has projected them into the air, but this embodiment, however, allows bringing the blades closer and avoiding the inner walls which, even transparent, impede the visibility of the projectiles.

It is also possible to provide one or several basket(s) or other receptacle(s) on top of the tube(s), in order to house the projectiles before the user decides to make them fall back for example by turning over or shaking the receptacle(s). This embodiment is for example suitable for decorative or precious projectiles which may thus be admired more easily in their receptacle. In one embodiment, each projectile may land in several possible receptacles, for example multiple housings in a horizontal or tilted plate; the music box then may constitute a lottery or skill game, and generate numbers corresponding to the numbers of receptacles where the projectiles land. It is also possible to provide a game in which the projectiles must pass through a small hole in a plate; the object is then to succeed to make most projectiles pass through this opening in a given time.

Figure 8:
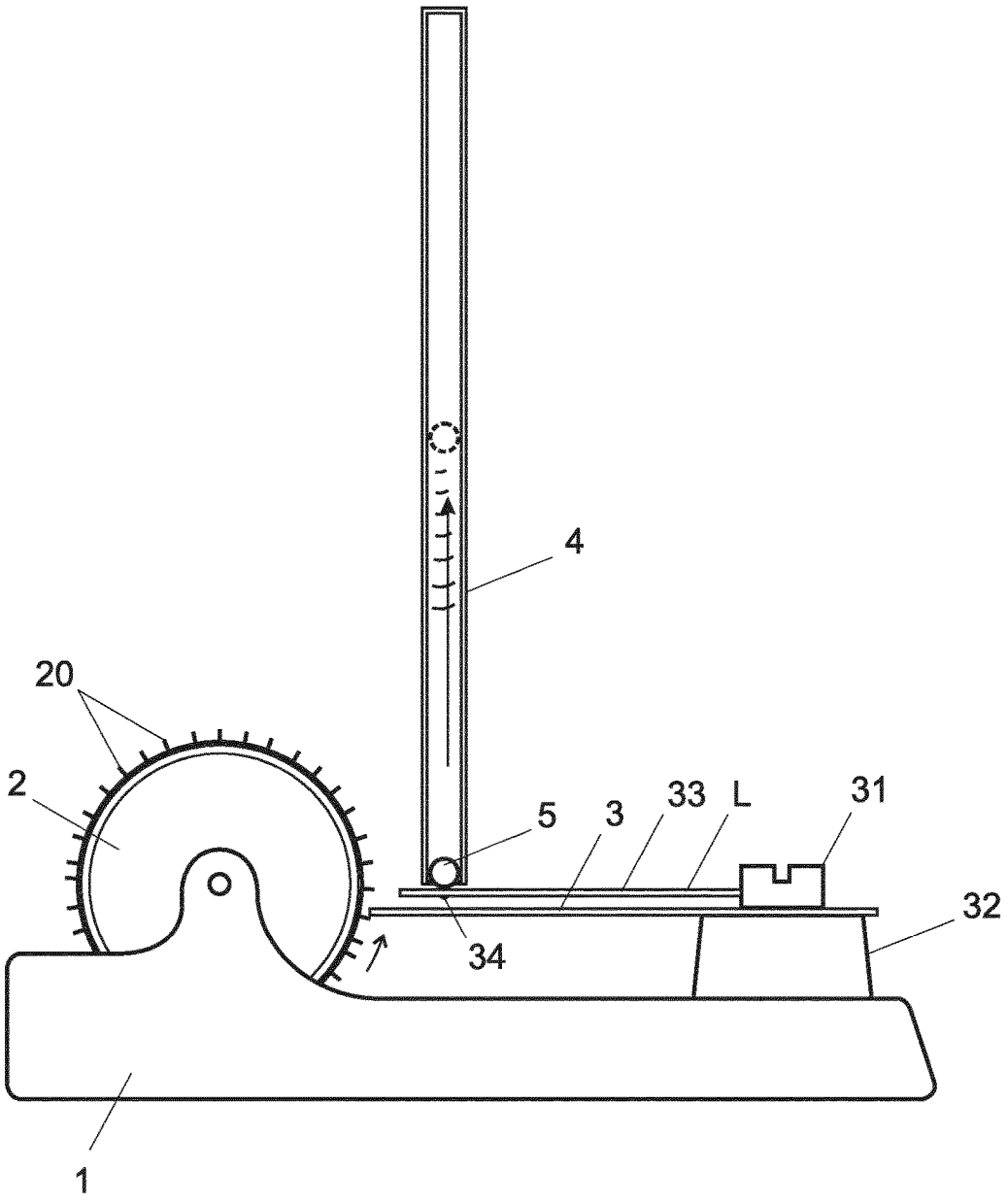
FIG. 8 illustrates an overall view of a music box according to a seventh embodiment of the invention.
Figure 9A:
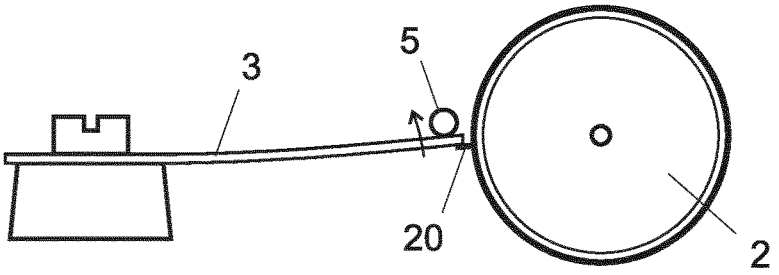
FIGS. 9*a* to 9*d* illustrate how the blades of a comb are vibrated by the cylinder tips.
Figure 9B:
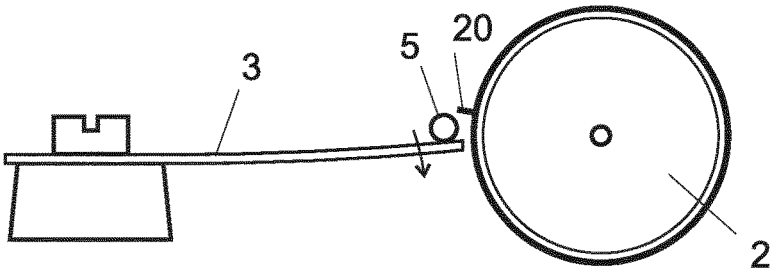
Figure 9C:
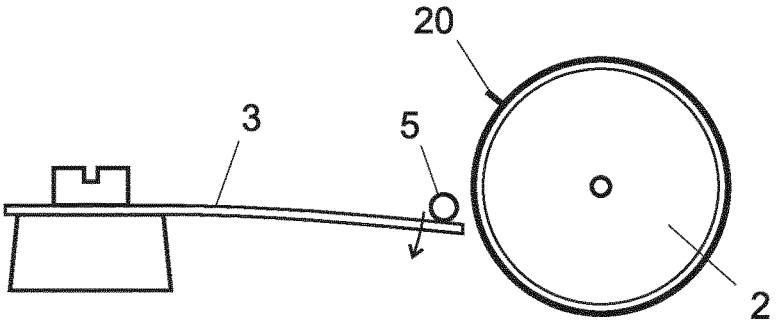
Figure 9D:
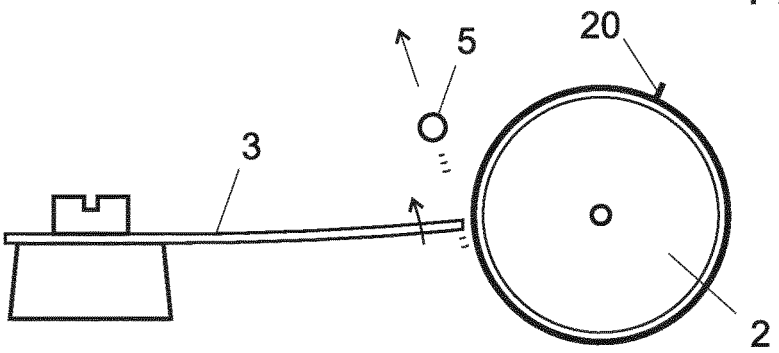

FIG. 8 illustrates a seventh embodiment in which, as in the variant of FIGS. 5A and 5B, an intermediate blade 33 is provided between the bottom of each tube 4 and the corresponding vibrating plate 3. The intermediate blade 33 is vibrated when the corresponding vibrating plate 3 is actuated, by means of a hammer 34 provided under the intermediate blade 33 or on the vibrating blade 3. Advantageously, at rest, the projectile 5 at rest is set on this intermediate plate 33, and projected into the air by the vibrations communicated to this intermediate blade by the main blade.

As in the variant of FIG. 5, the intermediate blade 33 is a damping blade and is advantageously made of a material softer than the steel-made vibrating blade 3, and is possibly coated with a damping material.

FIGS. 9A to 9D illustrate how a blade 3 is vibrated by a tip 20 of the cylinder 2. The projectile 5 is propelled upwardly when the blade vibrates for the first time upwards, in the position of FIG. 9D.

Figure 10:
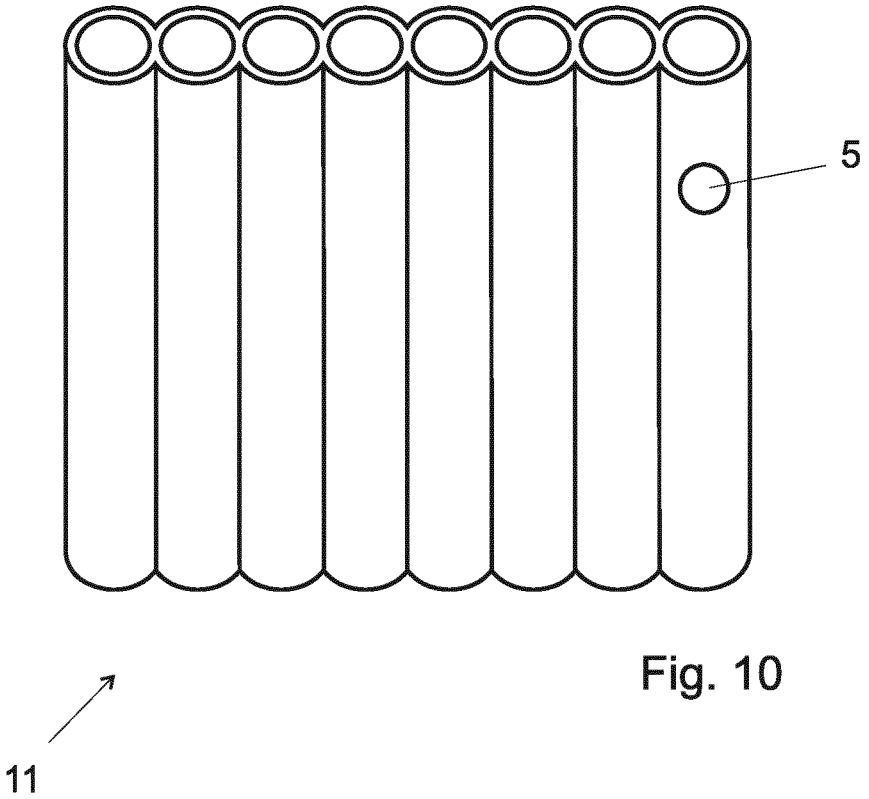
FIG. 10 illustrates in a side view a first example of tubes which may be used in the invention.
Figure 11:
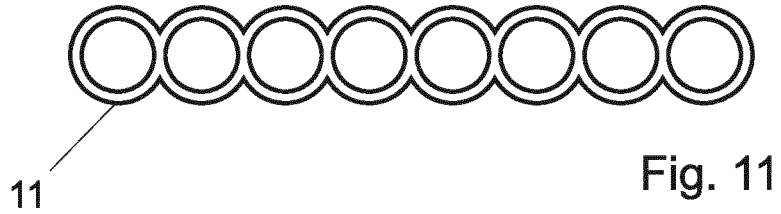
FIG. 11 illustrates in a top view a first example of tubes which may be used in the invention.
Figure 12:
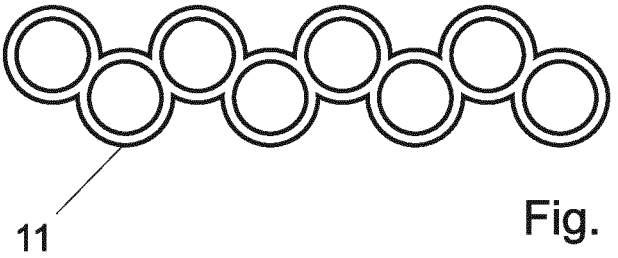
FIG. 12 illustrates in a side view of a second example of tubes which may be used in the invention.

The different tubes 11 serving to retain the projectiles over each respective blade of the comb may be assembled in one piece, for example by welding or bonding different tubes, or by injecting several plastic tubes side-by-side in the manner illustrated in FIGS. 10 and 11. As illustrated with the advantageous embodiment of FIG. 12, the tubes may be disposed in several rows, for example in two rows, for example randomly. This arrangement allows enlarging the diameter of the tubes and therefore the diameter of the projectiles, so as to make them more visible.

The diameter of the tubes and projectiles depends on the size of the music box; the projectiles must be small enough so as to reduce their mass, but large enough so as to be visible. Conclusive tests have been carried out with beads with a diameter comprised between 1.5 and 4 millimeters, which may cooperate with the blades of a comb spaced apart by a pitch between 1 and 5 millimeters.

Figure 13:
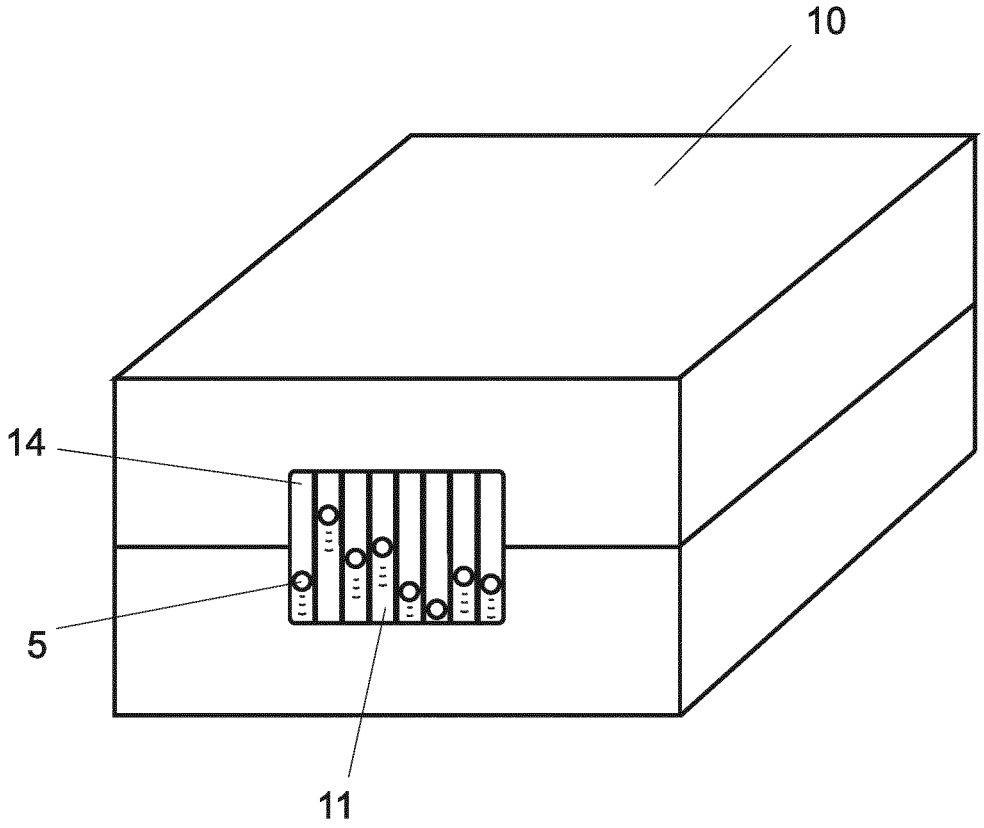
FIG. 13 illustrates a music box including a window for visualizing the tubes.

The music box mechanism described hereinabove may be placed in a box or in another object, for example a pendulum, a snuff box, etc. In the variant of FIG. 13, this box 10 includes a window 14 which hides the comb and the cylinder, but allows viewing the tubes and therefore visualizing, from outside the box, the displacement of the projectiles. Thus, the device appears as an equalizer, in which the projectiles corresponding to the frequently played notes are often into the air.

The music box mechanism described hereinabove may be placed in a watchcase in order to displace stones or other projectiles under the glass, for example according to a direction parallel to the glass. The direction of displacement is not necessarily vertical in this case, which allows the displacement of relatively heavy stones with necessarily reduced blades, at least over the required short distances. The stones may be brought back on the blades either by gravity, by positioning the watch in a vertical position, or by adapted return means, for example resilient means.

The invention claimed is:

1. A music box including:

a comb (30) with a plurality of vibrating blades (3) with different lengths so as to produce audible sounds with different frequencies when the vibrating blades are vibrated;

a plate or a cylinder (2) provided with tips (20) so as to alternately vibrate the different vibrating blades (3) when the plate or cylinder is rotated;

a visual animation device (4, 5) actuated by said vibrating blades (3);

characterized in that said visual animation device includes a plurality of projectiles (5) arranged to be actuated by said vibrating blades (3) so as to be projected by the displacement of the blades.

2. The music box according to claim 1, a retaining element (6, 7, 9, 11) being associated with each projectile (5) so as to ensure that said projectile falls back on a blade.

3. The music box according to claim 2, comprising a rod (7, 9) as a retaining element associated with each projectile, said rod being rotated and/or deformed upon displacement of said projectile.

4. The music box according to claim 2, comprising a wire (6) as a retaining element associated with each projectile.

5. The music box according to claim 4, each said wire (6) passing through a projectile (5).

6. The music box according to claim 5, each said wire (6) further passing through a vibrating blade (3) or a damping blade above a vibrating blade (3).

7. The music box according to claim 2, comprising a tube (11) as a retaining element associated with each projectile (5) to ensure that said projectile falls back on the vibrating blade (3) which has projected it.

8. The music box according to claim 7, including a number of tubes (11) equal to the number of vibrating blades (3).

9. The music box according to claim 7, said tubes (11) being at least partially transparent.

10. The music box according to claim 7, said tubes (11) flaring upwardly.

11. The music box according to claim 7, said tubes (11) being disposed in a random arrangement.

12. The music box according to claim 7, including a plurality of said tubes (11) forming a single injection-molded plastic element.

13. The music box according to claim 7, each tube (11) being orientated upwards and including a retainer to prevent the projectile (5) from getting out by the bottom of the tube.

14. The music box according to claim 1, a projectile (5) being associated with each vibrating blade (3).

15. The music box according to claim 1, arranged in such a manner that said vibrating blade project said projectiles (5) upwards, and to allow said projectile (5) to fall back under the effect of gravity.

16. The music box according to claim 1, comprising an intermediate blade (33) above each vibrating blade, each intermediate blade being vibrated by the corresponding vibrating blade (3) and transmitting this vibration to the corresponding projectile.

17. The music box according to claim 1, said projectiles being constituted by beads made of a synthetic material.

18. The music box according to claim 1, said projectiles being constituted by precious, semi-precious or ceramic stones.

* * * * *